United States Patent [19]

Hopfensperger et al.

[11] Patent Number: 5,007,801

[45] Date of Patent: Apr. 16, 1991

[54] IMPELLER MADE FROM A SHEET-METAL DISK AND METHOD OF MANUFACTURING SAME

[75] Inventors: Reinhold Hopfensperger, Dietelskirchen; Werner Eichhorn, Landshut, both of Fed. Rep. of Germany

[73] Assignee: Standard Elektrik Lorenz Aktiengesellschaft, Stuttgart, Fed. Rep. of Germany

[21] Appl. No.: 230,145

[22] Filed: Aug. 9, 1988

[30] Foreign Application Priority Data

Aug. 10, 1987 [DE] Fed. Rep. of Germany ..... 3726522

[51] Int. Cl.[5] ..... F01D 5/14

[52] U.S. Cl. ..... 416/223 R; 416/DIG. 3

[58] Field of Search ..... 416/223 R, 223 A, 237, 416/234, DIG. 3; 415/119; 72/379; 428/587; 29/889.3

[56] References Cited

U.S. PATENT DOCUMENTS

| | | | |
|---|---|---|---|
| 1,469,086 | 9/1923 | Henderson | 416/183 |
| 1,734,541 | 11/1929 | Tedman | 29/889.3 |
| 1,827,316 | 10/1931 | Haynsworth | 416/185 |
| 2,011,298 | 8/1935 | Osbun | 416/237 |
| 2,064,845 | 12/1936 | Moray et al. | 416/DIG. 3 X |
| 2,117,011 | 5/1938 | Pratt | 415/211.1 |
| 2,352,127 | 6/1944 | Sheldon | 416/183 |
| 2,731,193 | 1/1956 | Lall et al. | 29/889.3 |
| 3,951,611 | 4/1976 | Morrill | 416/234 X |
| 4,115,030 | 9/1978 | Inagaki et al. | 416/DIG. 3 |
| 4,184,804 | 1/1980 | Inagaki et al. | 416/DIG. 3 |
| 4,610,601 | 9/1986 | Gerfast | 29/889.3 X |

FOREIGN PATENT DOCUMENTS

| | | | |
|---|---|---|---|
| 72020 | 5/1943 | Czechoslovakia | 416/210 |
| 1503633 | 5/1965 | Fed. Rep. of Germany . | |
| 2617029 | 12/1976 | Fed. Rep. of Germany | 416/DIG. 3 |
| 412148 | 7/1910 | France | 416/DIG. 3 |
| 1360738 | 4/1964 | France . | |
| 58-159934 | 9/1983 | Japan | 29/889.3 |
| 2192432 | 1/1988 | United Kingdom | 416/DIG. 3 |

*Primary Examiner*—John T. Kwon

*Attorney, Agent, or Firm*—Spencer & Frank

[57] ABSTRACT

An impeller formed from sheet-metal by stamping and bending, at a low production cost, capable of delivering an increased quantity of air at a reduced noise level and with reduced power consumption and enhanced efficiency. The method of manufacturing the impeller from sheet metal incorporates sufficient versitility to allow the blades of the impeller to be formed to any desired configuration in order to provide an optimum shape for the intended impeller use. The blades can be curved or twisted and can extend perpendicular from the sheet-metal surface or at any desired angle for optimum utilization.

9 Claims, 3 Drawing Sheets

IMPELLER MADE FROM A SHEET-METAL DISK AND METHOD OF MANUFACTURING SAME

BACKGROUND OF THE INVENTION

The invention pertains to an impeller made from a sheet-metal disk and having a plurality of blades which are formed by cuts in the sheet-metal disk and are bent out of the plane of the latter.

Such an impeller is known (DE-OS 15 03 633). The known impeller is made from an approximately circular sheet-metal disk by making cuts into the latter and by bending the blades thus produced out of the plane of the sheet-metal disk by ninety angular degrees to one side or the other.

Although such prior-art impellers can be produced at low cost in the manner described above, they have two considerable disadvantages. One disadvantage is that only straight, outwardly extending radial blades can be made on the impeller in the manner described above. If the blades are to be only slightly curved, an increased expense caused by tools and material (e.g., material having special deep-drawing properties) is required. By this method, only slightly curved blades can be manufactured.

Since in the case of the prior-art impeller, the blades are bent out of the area of the impeller, only a limited area of the sheet-metal disk is available for the effective area of the blades, because for the folding step which is required when the blades are being bent, a given area is necessary where the sheet-metal disk is held.

If the prior-art impeller is to deliver a greater quantity of air, it is necessary, due to its unfavorable aerodynamic properties, either to drive the impeller at a high speed or to increase its diameter.

Both measures require a considerably higher driving power. Naturally, they also cause a considerably increased noise level. Since such blowers are predominantly used in electric stoves as circulation blowers, the motor is already at its limit of capacity, due to the high ambient temperature. A motor with a higher capacity adds to the expense of the entire blower unit.

SUMMARY OF THE INVENTION

It is therefore an object of the invention to improve the impeller in such a manner that, with the same diameter of the impeller, the blades have as large an effective blade area as possible, so that the impeller has a better efficiency at a reduced noise level. Simultaneously, however, the advantage of the low-cost manufacturing method by deforming a sheet-metal disk is to be maintained.

It is another object of the present invention to teach a method by which an impeller can be made from a sheet-metal disk at low-cost which delivers a greater quantity of air at a reduced noise level, through configuration of the impeller blades in a shape in conformance with the teachings of the present invention.

These and further objects of the present invention are achieved by an impeller in which, in accordance with the invention, the edges of sawtooth-shaped projections of a circular-saw-blade-shaped flat center piece are integrally connected with blade roots bent out of the plane of the center piece which pass into the radially extending blades whose plane makes approximately a right angle with the plane of the center piece.

A radial blower which is provided with the impeller in accordance with the invention has the advantage that to produce the same air flow as compared to the prior-art impeller, a considerably lower driving power of the motor is required. On the one hand, this is due to the larger effective blade area and on the other hand, to the aerodynamically improved design of the impeller in accordance with the invention. Furthermore, the noise level of the blower is also reduced. At the same quantity of air delivered, the power input of the drive motor of the blower provided with the impeller in accordance with the invention is reduced by more than 50 % as compared to a blower with the prior-art impeller.

BRIEF DESCRIPTION OF THE DRAWINGS

In the following, the invention will be explained in more detail with reference to the accompanying drawings, in which.

DETAILED DESCRIPTION OF EXEMPLARY EMBODIMENTS

Figure 1:
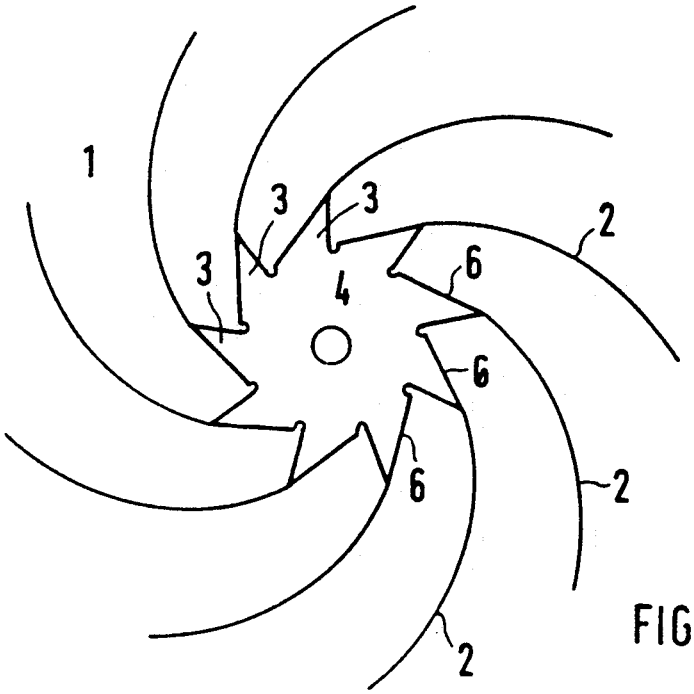
FIG. 1 is a top plan view of the front side of an embodiment of the impeller in accordance with the invention.
Figure 5:
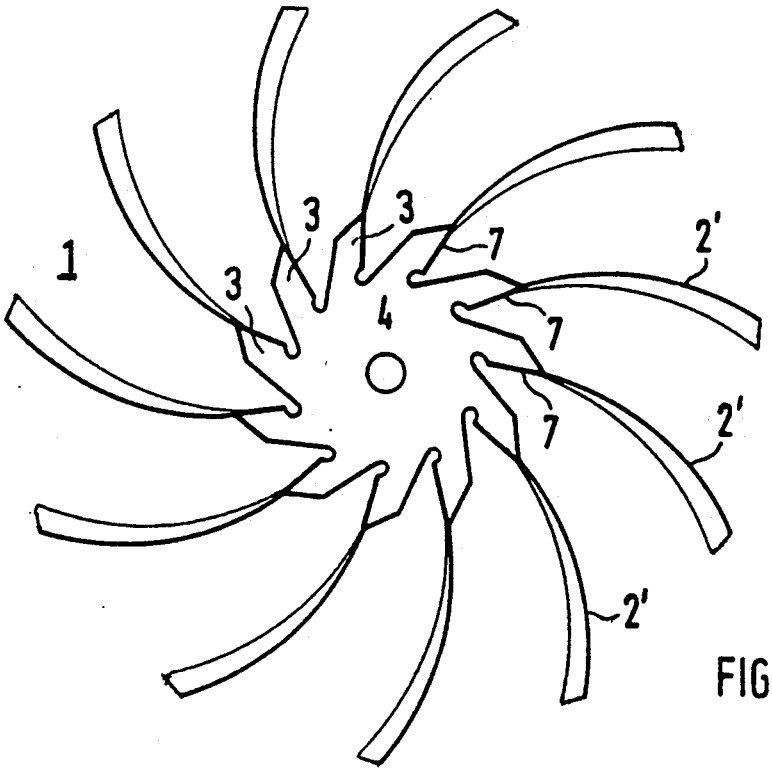
FIG. 5 is a top plan view of the front side of a further embodiment of the impeller in accordance with the invention.

As can be seen in FIG. 1, the impeller 1 has a flat center piece 4 in the form of a circular saw blade. The center piece 4 is an essentially circular blank which is provided with a plurality of sawtooth-shaped projections 3 at the periphery. Edges of the sawtooth-shaped projections 3 are integrally connected with blade roots 5 (not shown in FIGS. 1 and 2) and the blades 2, which make approximately a right angle with the plane of the center piece. The two embodiments of the impeller in accordance with FIG. 1 and FIG. 2 differ in that in the embodiment of FIG. 1, the blade roots 5, and thus the blades 2, are connected with the outside edges 6 of the sawtooth-shaped projections 3, while in the embodiment of FIG. 2, they are connected with the front edges 7 of the sawtooth-shaped projections 3. The blades are curved, and may be additionally twisted as are blades 2' illustrated in FIG. 5.

Figure 3:
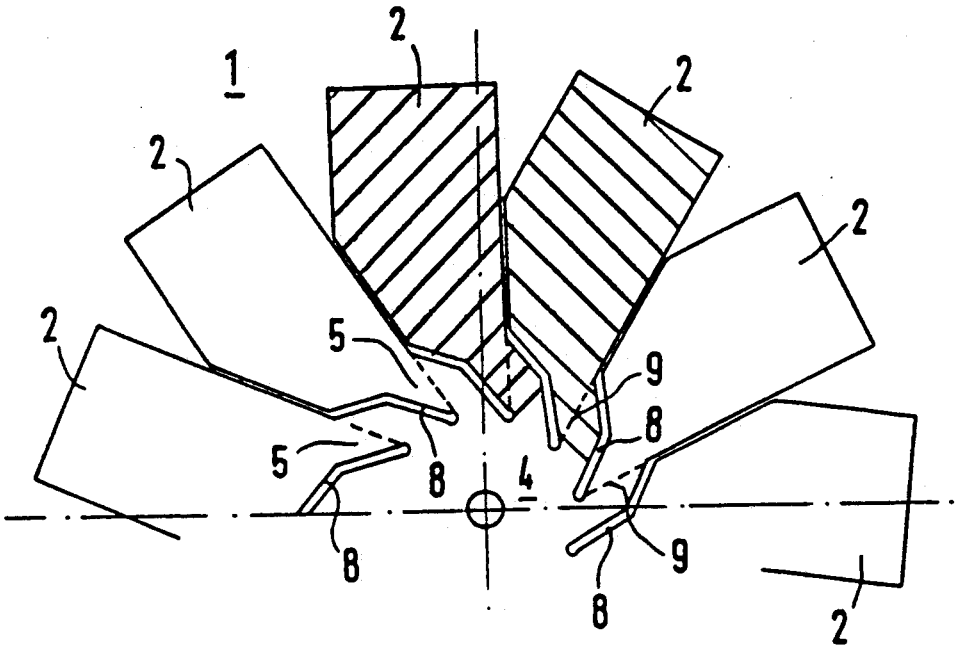
FIG. 3 is a top plan view of part of the development of the impeller stamped from sheet metal.

As is shown in FIG. 3, the development of the impeller 1 has a plurality of blades 2 which extend outwardly in the radial direction from the center piece 4. The blades 2 are separated by approximately S-shaped slots 8 which were formed during stamping, so that portions of the blades 2 extending radially outward of the roots 5 are separated at their radially extending edges from the adjacent blades by gaps formed by radially outward ends of the slots 8, the gaps being narrower than the width of the blades. The blades 2 are connected with the center piece 4 of the impeller only by way of the blade roots 5.

Figure 2:
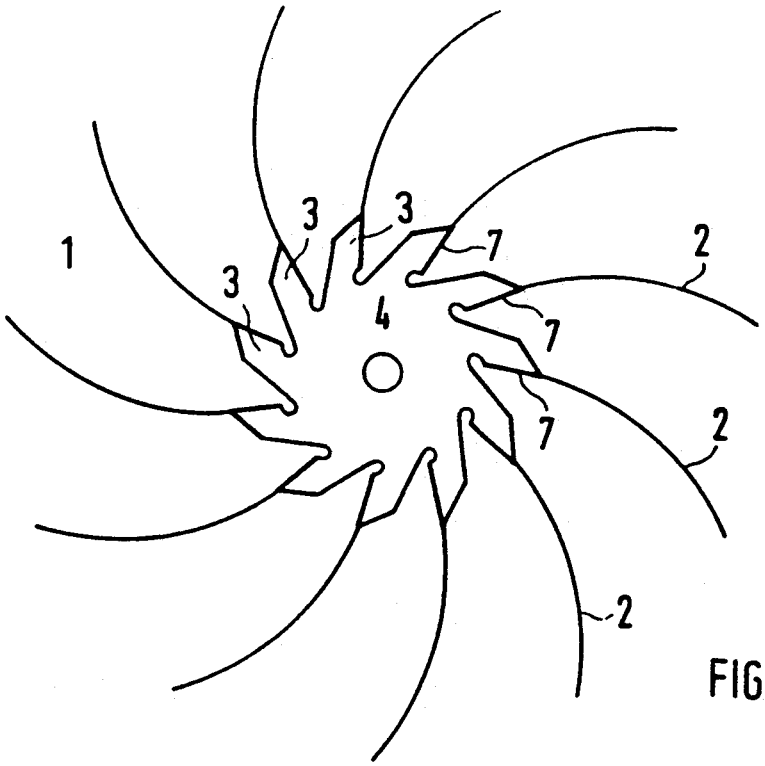
FIG. 2 is a top plan view of the front side of a different embodiment of the impeller in accordance with the invention.
Figure 4:
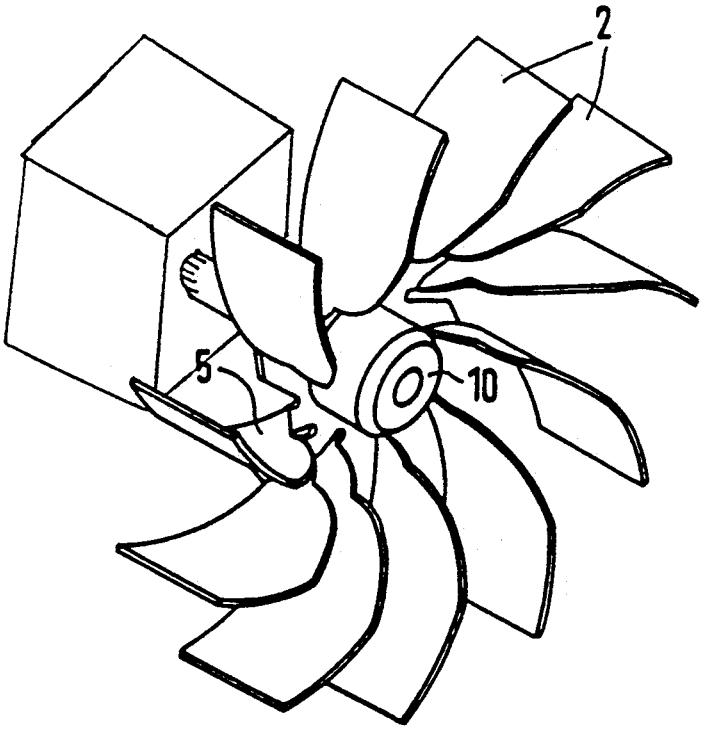
FIG. 4 is a perspective view of an embodiment of the impeller mounted on a motor to form a blower in accordance with the invention.

The impeller is manufactured in the following manner: after the development 1 has been stamped from a flat metal sheet, the blades are then bent to form the curvature of the blade surface illustrated in FIGS. 1, 2 and 4. The blades can also further be twisted about their longitudinal axis as desired to impart the desired final shape into the blade. Alternatively, if desired, the blades can be left flat and neither curved nor twisted if desired for the final configuration of the fan. The blade roots 5 are then bent at a dotted lines (fold lines) 9 by 90 angular degrees (also towards the viewer). After the center piece 4 has been provided with a hub 10, an impeller as shown in FIG. 2 or 4 is formed to be mounted on a drive shaft of an electric motor 12, thereby to provide a blower.

As can be seen from the drawings, the impeller in accordance with the invention can be manufactured with simple tools for any application in an aerodynamically optimum design. This is already possible in the case of cast impellers, which are much more expensive to manufacture; however, a different casting mold is needed for each shape of blade. Another advantage of the impeller in accordance with the invention is the considerably higher temperature resistance of the sheet steel generally used for the impeller in accordance with the invention, as compared to the commonly used aluminum die-cast impeller.

We claim:

1. An impeller made from a sheet-metal disk, comprising:

a plurality of radially outwardly extending blades having widths, said blades being formed by radial cuts in the sheet-metal disk, a circular-saw-blade-shaped flat center piece having sawtooth-shaped projections, and a plurality of blade roots bent out of the plane of said center piece and extending from said sawtooth-shaped projections, connecting said blades at approximately a right angle with the plane of said center piece, to said center piece, said blades having radially inward portions extending radially outward from said roots, said radially inward portions having opposite edges defined by the cuts, said radially inward portions of the respective blades having such dimensions that in a development of the impeller with said roots and said blades in the plane of said center piece, the edges of adjacent blades are substantially aligned with fold lines along which said roots are bent out of the plane of said center piece and said blades are separated by approximately S-shaped slots, each of said slots originating at one end thereof at a radially inward end of the fold line along which one of the roots is bent, said each of said slots terminating at a radially outward end thereof along an outward line which is located radially outside of and aligned with the fold line of another of the roots which is adjacent to one of the roots, the outward ends of said slots separating said edges of adjacent blades from each other by gaps which are narrower than the widths of the blades.

2. An impeller as claimed in claim 1, wherein said blade roots are connected with the leading edges of said sawtooth-shaped projections.

3. An impeller as claimed in claim 1, wherein said blade roots are connected with the trailing edges of said sawtooth-shaped projections.

4. An impeller as claimed in claim 1, wherein said blades are curved.

5. An impeller as claimed in claim 4, wherein said blades are additionally twisted.

6. A method of manufacturing an impeller from sheet material, comprising the following steps:

providing a flat blank, stamping the blank to form a center piece having sawtooth-shaped projections, blade roots adjacent the sawtooth-shaped projections, and successively adjacent blades extending radially outward from the blade roots, the blades having radially inward portions connected to the roots, the radially inward portions having opposite edges, said step of stamping includes the step of separating the blades with approximately S-shaped slots, each of the slots originating at one end thereof at a radially inward end of the straight line along which one of the blade is bent, each of the slots terminating at a radially outward end thereof along an outward line which is located radially outside of and aligned with the straight line of another of the blades which is adjacent to the one of the blades, the radially outward ends of said slots separating the opposite edges of a respective one of the blades from one of the edges of an adjacent blade by a respective gap which is narrower than widths of the blades, and bending the blades out of the plane of the center piece by about 90 angular degrees on a straight line at the boundary between the sawtooth-shaped projections and the blade roots.

7. A method as claimed in claim 6, comprising the further step of:

bending the blades into a bowllike shape to produce curvature of the blades.

8. The method of claim 6, comprising the further step of twisting said blades.

9. In a radial blower having an impeller and means for rotating the impeller to blow a gas, the improvement wherein the impeller is made from a sheet-metal disk and includes:

a plurality of radially outwardly extending blades having widths, said blades being formed by cuts in the sheet-metal disk, a circular saw-blade-shape flat center piece having sawtooth-shaped projections, and a plurality of blade roots bent out of the plane of said center piece and extending from said sawtooth-shaped projections, at approximately a right angle with the plane of said center piece, to said center piece, said blades having radially inward portions extending radially outwardly from said roots, said radially inward portions having opposite edges defined by the cuts, the radially inward portions of the respective blades having such dimensions that in a development of the impeller with the roots and blades in the plane of said center piece, the edges of adjacent blades are substantially aligned with fold lines along which said roots are bent out of the plane of said center piece, said blades are separated by approximately S-shaped slots, each of said slots originating at one end thereof at a radially inward end of the fold line along which one of the roots is bent, said each of said slots terminating at a radially outward end thereof along an outward line which is located radially outside of and aligned with the fold line of another of the roots which is adjacent to the one of the roots, and said outward ends of said slots separating said edges of adjacent blades from each other by gaps which are narrower than the widths of the blades.

* * * * *